US005107693A

United States Patent [19]

Olszewski et al.

[11] Patent Number: 5,107,693

[45] Date of Patent: Apr. 28, 1992

[54] METHOD OF AND APPARATUS FOR HYDRAULICALLY DEFORMING A PIPE-SHAPED HOLLOW MEMBER

[75] Inventors: Egon Olszewski; Rainer Hansen, both of Paderborn-Elsen; Dieter Töpker, Paderborn-Neuenbeken, all of Fed. Rep. of Germany

[73] Assignee: Benteler Aktiengesellschaft, Paderborn, Fed. Rep. of Germany

[21] Appl. No.: 704,325

[22] Filed: May 23, 1991

[30] Foreign Application Priority Data

May 26, 1990 [DE] Fed. Rep. of Germany ..... 4017072

[51] Int. Cl.[5] ..... B21D 22/10

[52] U.S. Cl. ..... 72/58; 72/62; 29/421.1

[58] Field of Search ..... 72/58, 61, 62, 369; 29/727, 421.1

[56] References Cited

U.S. PATENT DOCUMENTS

| | | | |
|---|---|---|---|
| 1,943,560 | 1/1934 | Squires | 72/57 |
| 2,047,296 | 7/1936 | Squires | 72/57 |
| 4,567,743 | 2/1986 | Cudini | 72/61 |
| 4,590,655 | 5/1986 | Javorik | 72/62 |
| 4,744,237 | 5/1988 | Cudini | 72/61 |
| 4,761,982 | 8/1988 | Snyder | 72/58 |
| 4,788,843 | 12/1988 | Seaman et al. | 72/62 |
| 4,827,605 | 5/1989 | Krips et al. | 72/61 |
| 4,829,803 | 5/1989 | Cudini | 72/61 |

FOREIGN PATENT DOCUMENTS

| | | | |
|---|---|---|---|
| 464359 | 3/1975 | U.S.S.R. | 72/62 |

*Primary Examiner*—David Jones

*Attorney, Agent, or Firm*—Toren, McGeady & Associates

[57] ABSTRACT

A die (2) formed of two halves (4, 5) is placed in a container (7) filled with an incompressible liquid. The die halves have a plane of contact disposed in parallel relation with and spaced from the axis of a hollow member to be deformed within a die cavity formed by the die halves. Mandrils (15) are forced into sealing contact with the open ends of the hollow member by hydraulic cylinders. A high deformation pressure is supplied into the hollow member and the mandrils are secured in sealing contact with the hollow member against such pressure.

8 Claims, 4 Drawing Sheets

METHOD OF AND APPARATUS FOR HYDRAULICALLY DEFORMING A PIPE-SHAPED HOLLOW MEMBER

BACKGROUND OF THE INVENTION

The present invention is directed to a method of hydraulically deforming a pipe-shaped hollow member in a die formed of two die halves. The hollow member is inserted into the die cavity and the two halves of the die are closed for effecting a first deformation of the hollow member. In the first deformation only portions of the outside surface of the hollow member ar displaced into contact with the die cavity surfaces. Subsequently, the open ends of the hollow member are sealed and by applying hydraulic pressure within the hollow member it is deformed into complete contact with the cavity surfaces.

In addition, the present invention is directed to an apparatus for hydraulically deforming the pipe-shaped hollow member where the die is made up of two die halves displaceable toward one another for deforming the hollow member. Means are provided for sealing the open ends of the hollow member. Other means apply hydraulic pressure to the interior of the hollow member.

Such a method or apparatus are part of the state of the art as disclosed in EP 0 294 034 A2. In this known art, the hollow member is placed within an open die and then the ends of the hollow member are closed or sealed. With the die still open a pressure in introduced into the interior of the hollow member by a hydraulic fluid for at least overcoming the frictional forces which the die halves exert on the hollow member when the die is closed and which forces tend to press portions of the wall of the hollow member into the gap between the die halves. The hydraulic pressure within the hollow member is lower than the elastic limit or yield strength of the material of the hollow member.

After applying the internal pressure, the die is closed by moving the die halves toward one another, whereby the cross-section of the hollow member is approximately adapted to the shape of the die cavity. Next, the hydraulic pressure within the hollow member is increased. As a result, the wall segments of the hollow member are stretched beyond the elastic limit until they are completely pressed into contact with the die cavity.

A disadvantage of this known method and apparatus is that the hydraulic pressure increases in the closed interior of the hollow member, due to the volume reduction when the die halves are closed. There is the danger that the hollow member can crack of even burst.

It would be possible to continuously monitor the hydraulic pressure within the hollow member when the die is closed and to lower it to correspond to the reduction of the inside space volume, however, such a procedure can be performed only at not justifiably high costs, because of the control and/or regulation or technology of the installation.

Another, drawback is that the hollow member is filled with a hydraulic fluid prior to the initial deformation. Consequently, it is necessary to provide a perfect seal for the hollow member after it has been filled. This step requires extraordinarily high cost, since the seal must be maintained in a perfect state during the initial deformation as well as the final deformation.

SUMMARY OF THE INVENTION

Therefore, the primary object of the present invention is to improve the method and apparatus as mentioned above, so that an economical hydraulic deformation of pipe-shaped hollow members can be achieved with relatively limited use of sealing means. In accordance with the present invention, in the method, before the first deformation step is carried out, the die and the hollow member are placed into a bubble free incompressible liquid where the first deformation step is carried out. Subsequently, while retaining the die and hollow member in the incompressible liquid, the ends of the hollow member are sealed and a hydraulic pressure is applied to the interior of the hollow member for effecting the second deformation.

Accordingly, a possibly prebent hollow member having a length sufficient to accommodate the final shape is placed in the open die. Next, the hollow member and die are placed into a incompressible liquid, such as water, and, since the ends of the hollow member are open, the liquid can flow into the interior of the hollow member filling it completely. When the hollow member is completely filled with liquid devoid of any bubbles, the die halves are moved together while the ends of the hollow member remain open. As the die halves move together, the hollow member full of liquid and located within the liquid is deformed approximately to the shape of the die cavity formed by the die halves.

After the first deformation step, the ends of the hollow member are sealed. Care must be exercised that the liquid within the hollow member continues to be free of bubbles.

The hydraulic pressure within the interior of the hollow member is increased and the wall of the hollow member is pressed into complete surface contact with the surface of the die cavity.

The deformation procedure is terminated at that point, the die halves are moved apart and the completely deformed hollow member is removed from the die for further processing.

A considerable advantage of the present invention is that the hollow member to be deformed must not be sealed in an expensive manner at its ends. The hollow member is placed in the incompressible liquid so that it arrives at the die, possibly prebent, with the liquid located in the hollow member being free of bubbles due to an appropriate quieting process. Subsequently, the initial deformation of the hollow member can be carried out without difficulty by closing the die halves but with the ends of the hollow members still open whereby there is no problem with uncontrolled deformation procedures. It is only after the initial deformation that the end faces of the hollow member are tightly sealed. After the ends are sealed, the required pressure is developed within the hollow member to press its wall surface into contact with the surfaces defining the die cavity.

Accordingly, sealing the ends of the hollow member is required only when the initially deformed hollow member is to be brought into its final form. As a result, it is possible with relatively simple means to produce dimensionally accurately shaped members from round or angular members by hydro forming as is especially desirable for the axle housings of automobiles.

Since no wall thickness changes can occur in the hollow member during the deforming process, it is unnecessary to provide special control and/or regulation technology measures for changing the pressure within the hollow member caused by volume changes. Accordingly, the apparatus for hydraulically deforming a pipe-shaped hollow member includes a die formed by die halves within a plane of contact traversing the die cavity parallel with and spaced from the axis of the hollow member. The die and the hollow member are placed in a container filled with an incompressible liquid so that the liquid fills the hollow member. The die cavity has passages at opposite ends for receiving the ends of the hollow member. The passageways are conically shaped with their surfaces converging inwardly toward the die cavity. Conically shaped mandrils seal the ends of the hollow member and the mandrils are insertable under hydraulic pressure. The means for applying hydraulic pressure include at least one high pressure hydraulic pump connected with the interior of the hollow member and also acting on the mandrils for sealing them in the die cavity passageways.

An advantageous feature of the invention is that the plane of contact of the die halves does not coincide with a plane passing through the axis of the hollow member. Instead, the plane of contact is spaced from and parallel with the axis. Accordingly, the plane of contact is located in a region preventing portions of the wall from being pressed into the space between the die halves during the initial deforming step. Therefore, it is assured during the deformation operations that the wall of the hollow member deforms into the corners of the die cavity and during the final deformation the walls can roll over beyond the plane of contact of the die halves. As a consequence, the wall thickness of the hollow member and the desired quality of the deformed hollow member can be assured without any question.

Another significant advantage of the invention is the arrangement of the conical mandrils to be inserted into the ends of the hollow member. These mandrils are inserted into the end faces only when the final deformation step is to be performed. Since the passageways opening into the die cavity for receiving the hollow member ends are conically shaped, the walls of the hollow member located in the passageways are flared by the conically shaped mandrils. Thereby the area pressure produced in the hollow member wall exceeds the elastic limit or yield strength of the wall and affords an absolutely tight seal of the hollow member during the final deformation operation.

The hydraulic pressure within the hollow member is produced by a high pressure hydraulic pump. In addition, the pump provides the pressure for holding the mandrils in sealed contact with the ends of the hollow member.

An advantageous feature of the apparatus is the provision of annular beads or projections in the surface of the mandrils in contact with the ends of the hollow member. The annular beads act as cutting rings when the mandrils are pressed into the ends of the hollow member and increase the sealing effect. Since the material of the mandrils can be considerably harder than the material of the hollow member being deformed, the annular beads have a correspondingly long useful life. In cross-section, the annular beads can be saw-tooth-like shaped with sharp edges. It is also possible, however, that the annular beads are rounded off or are trapezium-shaped. Apart from the cross-sectional shape of the annular beads, the additional sealing they provide does not result in any disadvantage in the deformed hollow member since the ends of the hollow member contacted by the annular beads or the mandril are cut off in the final processing of the hollow member. While only one annular bead can be provided at each mandril, it is preferably to provide two or more such beads for each mandril.

Each mandril can be coupled with a hydraulic cylinder. The hydraulic cylinder, equipped with a piston rod and pistons and using an incompressible liquid, can supply high axial pressure, so that the mandrils are pressed into the ends in the hollow member in a perfectly tight fit and the seal is maintained when the final deformation is effected at an increased pressure.

The sealing action of the mandril in the ends of the hollow member is improved by providing double pistons within the hydraulic cylinder. The pistons are spaced in the axial direction of the cylinder and one of them can be acted on by the high pressure pump assuring the increase in the pressure in the hollow member so that the mandrils remain in tightly pressed sealing contact with the ends of the hollow member.

Accordingly, each face of the piston acted on the by high pressure pump is dimensioned as large as or larger than the oppositely acting surface within the hollow member, whereby the force component within the hollow member is compensated by the pressure acting on the mandrils and forcing them into the ends of the hollow member. Accordingly, the sealing of the ends remains assured during the final deformation step.

Another important feature is the provision of a channel through the mandrils connected to a line communicating with the high pressure pump. The pistons of the hydraulic cylinders can be supplied with hydraulic pressure from the high pressure pump through bypass lines for holding the mandrils in tightly sealing engagement with the ends of the hollow member. In a preferred arrangement, the effective surfaces of the pistons have a larger area than the are of the other pistons used to direct the mandrils into the ends of the hollow member.

The pressure acting on the piston and supplied by the high pressure pump is hydraulically or electro-hydraulically regulated as a function of the pressure within the interior of the initially deformed hollow member, and such pressure can be applied directly through a separate valve.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
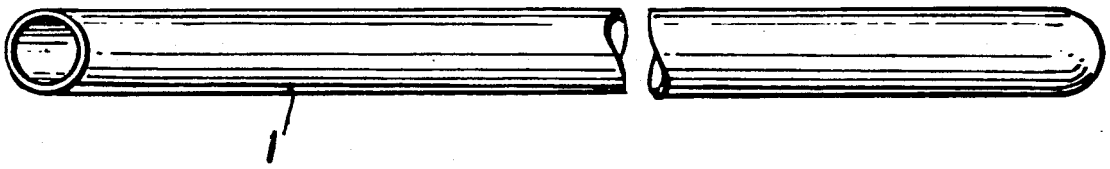
FIG. 1 is a side view of a straight pipe having a rounded cross-section.

A straight pipe or hollow member 1 of circular cross-section is shown in FIG. 1 and is to be hydraulically deformed into an axle member for a passenger motor car.

Figure 2:
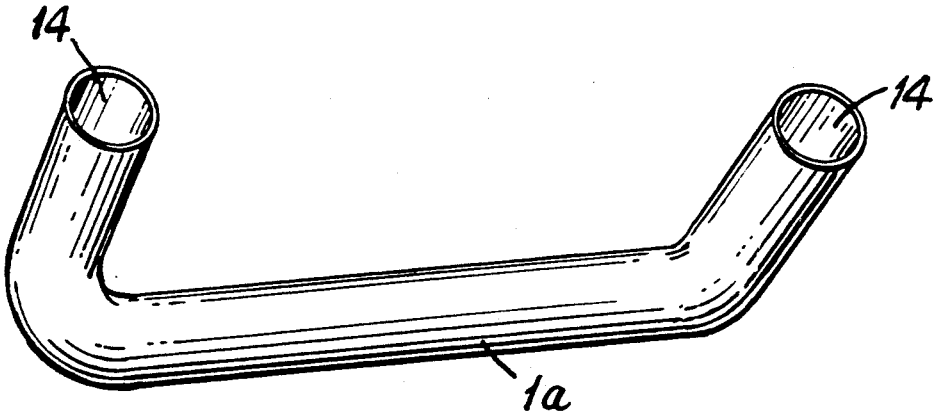
FIG. 2 is a perspective view of the pipe shown in FIG. 1 with a prebent configuration.

At the outset, the pipe 1 is bent as shown in FIG. 2, so that in the bent state 1*a* it can be placed into a die 2 having a die cavity in which the pipe is to be deformed.

Figure 3:
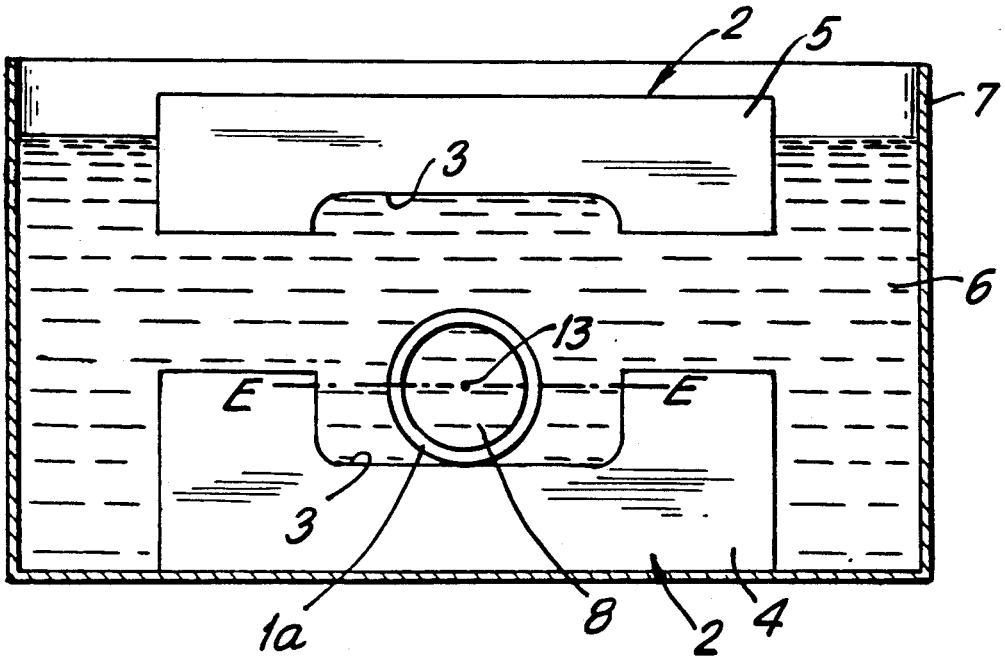
FIG. 3 is a schematic cross-section through a container filled with an incompressible liquid with an open die in the container and the prebent tube of FIG. 2 inserted into the die.
Figure 4:
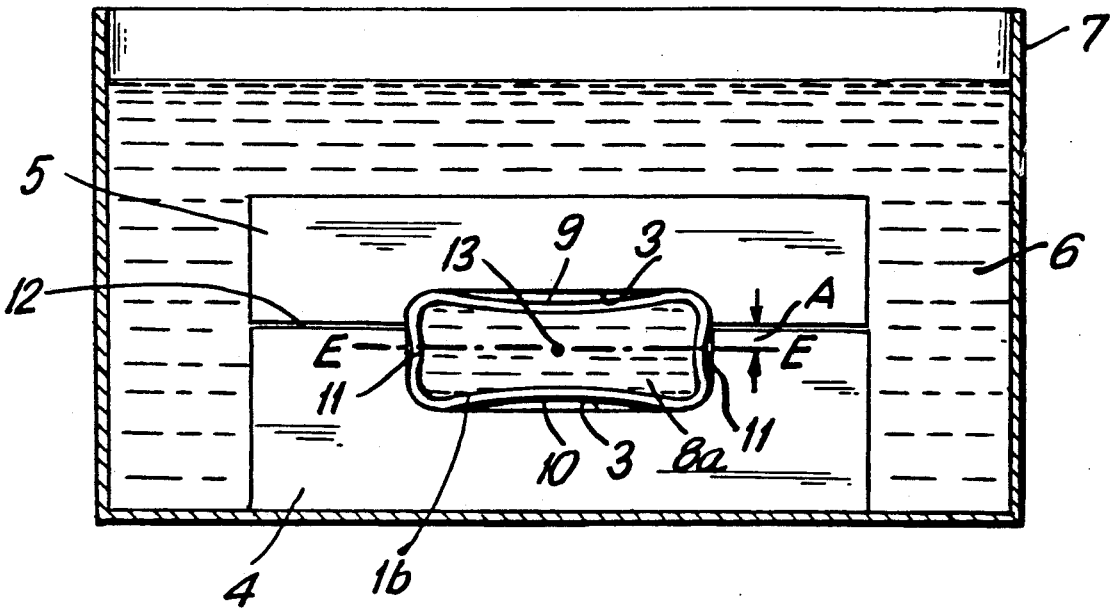
FIG. 4 is a view similar to FIG. 3 with the die halves of the die in the closed position and the hollow member having undergone an initial deformation.

The die 2 is shown in the opened condition in FIG. 3. Die 2 has a lower or bottom die half 4 and an upper or top die half 5. The die halves can be mechanically moved toward one another in a manner not shown. Die 2 is located in a container 7 filled with an incompressible liquid or water 6. After the bent pipe 1*a* of FIG. 2 has been placed in the bottom die half 4, as shown in FIG. 3, water 6 enters into the interior 8 of the pipe 1*a*. After the water has achieved a steady state, so that it no longer contains any air bubbles, the top die half if moved downwardly against the bottom die half, and the bent hollow member 1*a* is deformed into the shape shown in FIG. 4, wherein the hollow member no longer has a circular cross-section. As can be seen in FIG. 4, the pipe 1*b* has an approximately rectangularly cross-section, however, the top side 9, the bottom side 10 and the opposite narrow sides 11 are curved inwardly with the outside surfaces being concave. Only in the corner regions of the die cavity 3 does the hollow member 1*b* bear against the surfaces of the die cavity.

It can be noted that the plane of contact 12 of the die halves 4 and 5 is parallel with but is spaced by a dimension A from a horizontal plane E—E extending through the axis 13 of the pipe 1, 1*a*. Accordingly, when the hollow member is finally deformed the material of its wall is prevented from being squeezed into a space located between the die halves surfaces forming the plane of contact 12.

While the bent hollow member is deformed into the cross-sectional shape shown in FIG. 4, the ends 14 of the hollow member 1*a* remain open.

Figure 5:
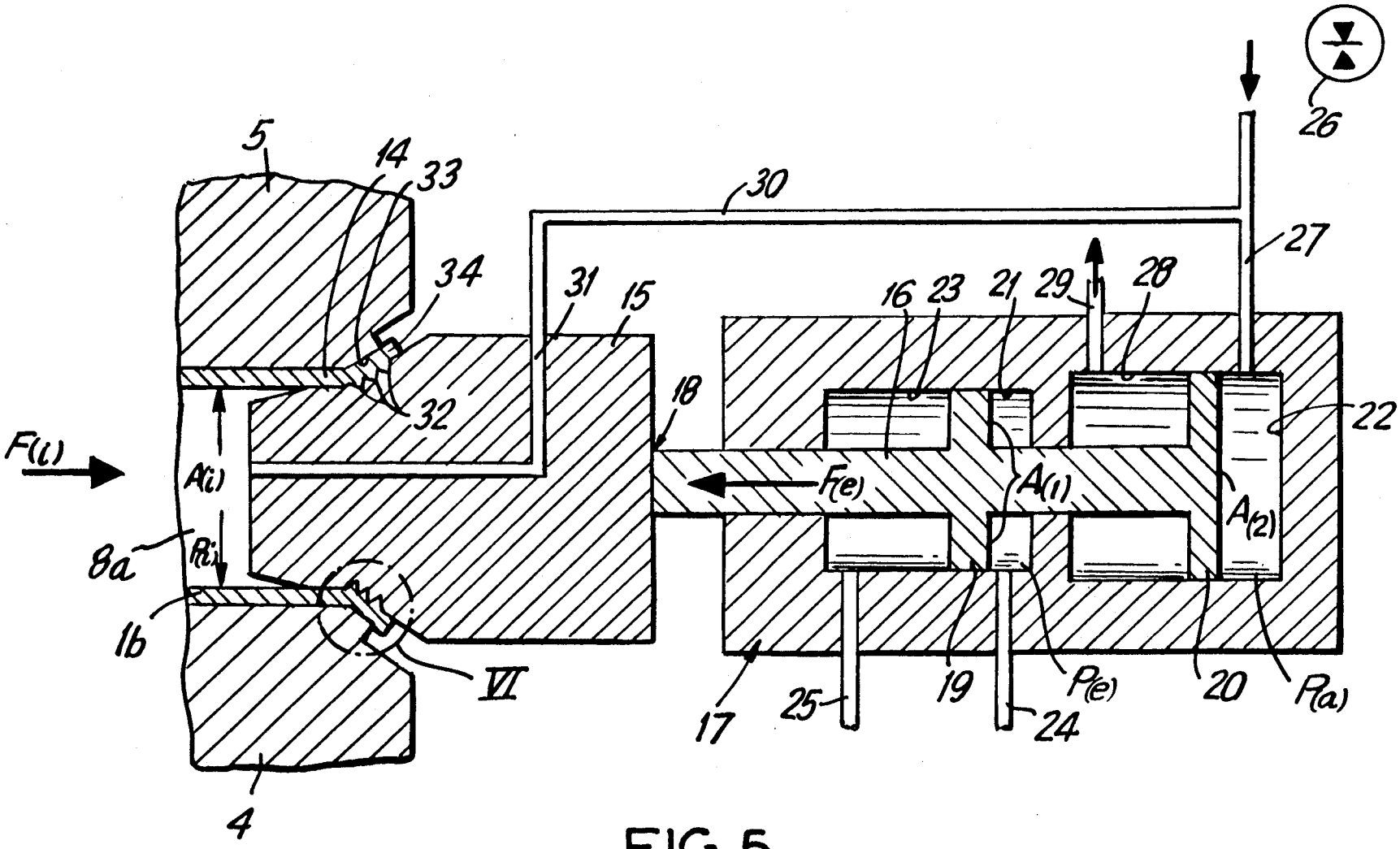
FIG. 5 is a side view in section of a hollow member deformed in the die and with a sealing means and a pressure unit means shown on a larger scale than in the previous Figures.

Conically shaped mandrils are pressed into the round ends of the deformed hollow member 1*b* for effecting the final deformation step. In FIG. 5 only one end of the hollow member 1*b* is shown.

The mandrils 15 are coupled to a piston rod 16 extending axially out of a hydraulic cylinder 17. The coupling location 18 can be detachable. Within the hydraulic cylinder 17, pistons 19, 20 are connected to the piston rod 16 and are spaced apart in the axial direction of the rod. Piston 19 has a piston area A(l) and piston 20 has a different sized area A(2). Hydraulic pressure P(e) acts on the piston 19 while a pressure P(a) acts on the piston 20. The cylinder spaces 21, 22 acted upon by the pressures P(e) and P(a) are separated by tight seals. While piston 19 in the cylinder space 21, and the cylinder space 23 can be acted upon by an incompressible medium, such as water, through lines 24, and 25, only the piston face A(2) can be acted on by pressure from a high pressure hydraulic pump 26 through a bypass line 27 acting on the piston 20. The cylinder space 28 on the opposite side of piston 20 from the cylinder space 22 is vented to the atmosphere through a line 29.

In addition, high pressure pump 26 is connected to the interior 8*a* of the deformed hollow member 1*b* through a line 30 and a channel 31 extending through one of the mandrils 15.

Figure 6:
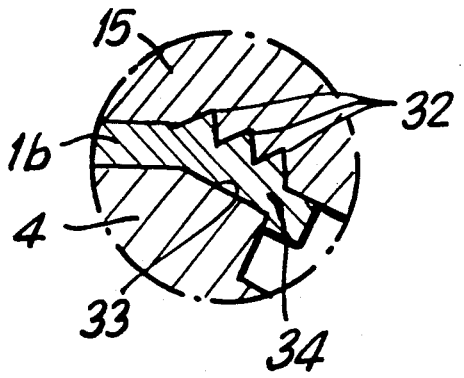
FIG. 6 is a sectional view of the circled region VI in FIG. 5 and shown on an enlarged scale.

Moreover, as shown in FIGS. 5 and 6, the mandrils are provided with saw tooth-like annular beads 32 arranged next to one another in the surface in contact with the ends 14 of the hollow member. It can also be seen in FIGS. 5 and 6 that the passageways 33 opening from the die cavity 3 are designed in a conically shaped manner.

When the mandrils 15 are inserted into the ends 14 of the deformed hollow member 1*b* by the pistons 19 with the pressure acting on the piston surface areas A(l) the mandrils with the annular beads 32 are pressed into the ends of the hollow member 1*b* so that the ends are deformed outwardly into contact with the conically shaped passageways 33 out of the die cavity 3.

Accordingly, the flaring 34 at the ends of the deformed hollow member 1*b*, as shown in FIGS. 5 and 6 is attained. At this location, the pressure produced in the hollow member wall exceeds the elastic limit or yield stress of its material.

The sealing action is augmented by the adjacent annular beads 32 in the mandrils in the contact region with the ends 14 of the deformed hollow member 1*b*.

The force F(e) required for the final deformation of the hollow member 1*b* is produced by the pistons 19 through the piston rod 16 at the ends of which the mandrils 15 are arranged by directing water against the piston area A(l) of the piston through the line 24.

Figure 7:
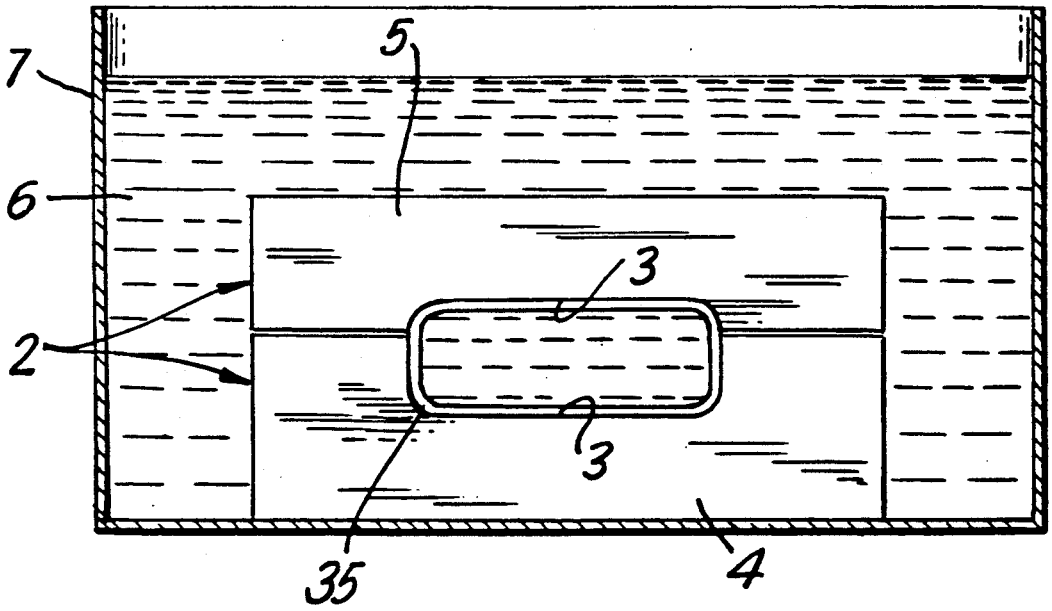
FIG. 7 is a view similar to FIG. 4, however, with the hollow member in the fully deformed shape.

Thereupon, water is directed into the interior 8*a* of the deformed pipe 1*b* by the high pressure pump 26 through the line 30 and the channel 31 producing a high pressure P(i) and the wall or outside surface of the deformed pipe 1*b* is pressed over its entire area against the corresponding surface of the die cavity 3, note FIG. 7. Accordingly, the hollow member section 35 is formed. When the internal pressure P(i) in the interior 8*a* of the deformed hollow member 1*b* is increased, the mandrils can not be displaced out of the sealing position, because due to the pressure developed by the high pressure pump 26 acting on the pistons 20 through the bypass line 27, a pressure P(a) acts on the piston faces A(2). Since the area of the piston faces A(2) of the pistons 20 are approximately equal to or larger than the area acted on by the pressure P(i) in the inside surface A(i) on the end faces of the mandrils 15 within the deformed tubular member 1*b*, the force components F(i) urging the mandrils 15 outwardly and produced by the pressure P(i) necessary for the deforming process, is compensated by the pressure P(a) acting on the piston faces A(2) of the pistons 20.

While specific embodiments of the invention have been shown and described in detail to illustrate the application of the inventive principles, it will be understood that the invention may be embodied otherwise without departing from such principles.

We claim:

1. Method of hydraulically deforming a pipe-shaped hollow member (1), with open ends (14) and an outside surface, in a die (2) made up of two die halves (4, 5) with each die half forming a portion of a die cavity for receiving the hollow member, comprising the steps of inserting the hollow member into one portion of the die cavity in one of the die halves, closing the die halves and effecting a first deformation of the hollow member with only portions of the outside surface of the hollow member displaced into contact with the cavity surfaces, sealing the open ends of the hollow member, and applying hydraulic pressure within the hollow member retained in the closed die and pressing the outside surface of the hollow member into full contact with the cavity surfaces for effecting a second deformation of the hollow member, wherein the improvement comprises before the first deformation step placing the die and hollow member into a bubble-free incompressible liquid and effecting the first deformation therein, and while retaining the die and hollow member in the incompressible liquid, sealing the ends of the hollow member and applying hydraulic pressure to the interior of the hollow member for effecting the second deformation.

2. Apparatus for hydraulically deforming an axially extending pipe-shaped hollow member having open ends and an outside surface, comprising a die (2) made up of two die halves (4, 5) displaceable toward one another and each die half forming a part of a die cavity (3) for deforming the hollow member, means (15) for sealing the open ends (14) of the hollow member, and means for applying hydraulic pressure to the interior of the hollow member, wherein the improvement comprises that said die halves (4, 5) have opposite ends for receiving the open ends of the hollow member and a plane of contact in a closed position of the die traversing the die cavity (3) with the plane of contact being parallel with and spaced from a center of the die cavity extending between the opposite ends of said die halves, a container (7) filled with an incompressible liquid and said die in the closed position located within said container below a liquid level therein, die passageways formed by said die halves at opposite ends of the closed said die cavity and arranged to receive opposite ends of the hollow member when the hollow member is positioned in the closed die cavity, said passageways being conically shaped with the surfaces thereof converging inwardly toward the die cavity, said means for sealing comprising conically shaped mandrils (15) insertible under hydraulic pressure into said conically shaped passageways for sealing the ends of the hollow member positioned within said die cavity, said means for applying hydraulic pressure comprises at least one high pressure pump (26) and flow passages extending n part from said high pressure pump to and through at least one of said mandrils and opening to said die cavity for supplying hydraulic pressure and the hydraulic pressure acting on said mandrils for maintaining the mandrils in sealed engagement in said passageways (33).

3. Apparatus, as set forth in claim 2, wherein said mandrils each having a conically shaped surface with at least one annular bead arranged thereon for contacting the ends (14) of the hollow member positioned within the die cavity.

4. Apparatus, as set forth in claim 3, wherein each said mandril (15) is coupled with a hydraulic cylinder (17) located outwardly from said die cavity.

5. Apparatus, as set forth in claim 4, wherein said hydraulic cylinder (17) comprise an axially elongated piston rod (16) and two pistons (19, 20) secured to said piston rod and spaced axially apart, each of said pistons (19, 20) is located in a separate cylinder space (20, 23) hydraulically separated from one another and said piston rod is coupleable with one said mandril (15), and one said piston (20) in each said hydraulic cylinder (17) is in communication through a part of said flow passages with said high pressure hydraulic pump (26).

6. Apparatus, as set forth in claim 5, wherein said piston (20) has a face (A(2)) contacted by the pressure from the high pressure pump (26) and has an area at least as large as an area (A(i)) within the hollow member (**1*b*) positioned within the die cavity and acting directly on said mandril (15**).

7. Apparatus, as set forth in claim 6, wherein said flow passages includes a line (30) extending from said high pressure pump (28) through one said mandril (15) to said die cavity for applying hydraulic pressure from said high pressure pump to the interior (**8*a*) of the hollow member (1*b*) positioned within the die cavity and by bypass lines (27) connecting said pump with cylinder space (22) in said hydraulic cylinder (17) containing said pistons (20**).

8. Apparatus, as set forth in claim 6, wherein means for one of hydraulically or electro-hydraulically regulating pressure acting on said piston (20) as a function of pressure (P(i)) in the interior (**8*a*) of the hollow member (1*b***) located within said die cavity and applied directly through a separate valve.

* * * * *